US008261701B2

(12) United States Patent
Amann et al.

(10) Patent No.: US 8,261,701 B2
(45) Date of Patent: Sep. 11, 2012

(54) INTERNAL COMBUSTION ENGINE

(75) Inventors: Jörg Amann, Walheim (DE); Eberhard Bohnaker, Leutenbach (DE); Ricardo Hojczyk, Prague (CZ); Ulrich Kapinsky, Waiblingen (DE); Mark Reichler, Waiblingen (DE); Martin Rieber, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 903 days.

(21) Appl. No.: 12/285,477

(22) Filed: Oct. 7, 2008

(65) Prior Publication Data

US 2009/0114172 A1 May 7, 2009

(30) Foreign Application Priority Data

Nov. 2, 2007 (DE) ..... 10 2007 052 420

(51) Int. Cl.
*F01P 7/00* (2006.01)

(52) U.S. Cl. ..... 123/41.58; 123/73 R; 123/73 PP

(58) Field of Classification Search ..... 123/73 PP, 123/41.58, 73 R, 74 R
See application file for complete search history.

(56) References Cited

U.S. PATENT DOCUMENTS

| | | | | |
|---|---|---|---|---|
| 4,389,982 | A * | 6/1983 | Boyesen | 123/73 R |
| 5,329,913 | A * | 7/1994 | Suzuki et al. | 123/573 |
| 5,937,836 | A * | 8/1999 | Yonezawa et al. | 123/572 |
| 6,810,849 | B1 * | 11/2004 | Hirsch et al. | 123/185.3 |
| 7,225,769 | B2 * | 6/2007 | Uenoyama et al. | 123/73 A |

FOREIGN PATENT DOCUMENTS

DE 914 687 7/1954

* cited by examiner

*Primary Examiner* — Noah Kamen
*Assistant Examiner* — Grant Moubry
(74) *Attorney, Agent, or Firm* — Walter Ottesen

(57) ABSTRACT

An internal combustion engine has a cylinder (2) and a crankcase (4). A combustion chamber (3) is formed in the cylinder (2) and is delimited by a piston (5). The piston (5) rotationally drives a crankshaft (7) in a rotational direction (21) via a connecting rod (6). The crankshaft (7) is arranged in a crankcase interior space (17). A mixture inlet (9) is provided in the crankcase interior space (17). In the crankcase interior space (17), at least one flow conducting element (23, 33, 43, 53, 63, 73) is provided which is spatially fixed and this flow conducting element projects into the crankcase interior space (17) and lies opposite to the rotational direction (21) of the crankshaft (7).

18 Claims, 3 Drawing Sheets

INTERNAL COMBUSTION ENGINE

CROSS REFERENCE TO RELATED APPLICATION

This application claims priority of German patent application no. 10 2007 052 420.1, filed Nov. 2, 2007, the entire content of which is incorporated herein by reference.

BACKGROUND OF THE INVENTION

German patent publication 914 687 discloses an internal combustion engine which is configured as a two-stroke engine. A cover plate is mounted on the piston in the interior space of the crankcase. The cover plate is mounted below an opening in the piston through which the fresh charge of an air/fuel mixture flows into the combustion chamber at bottom dead center of the piston. In German patent publication 914 687, at bottom dead center of the piston, the fresh mixture is intended to flow along the inner side of the piston base and to so cool the same. This cooling takes place, however, only when the fresh air/fuel mixture flows through the opening in the piston, that is, only at bottom dead center. At top dead center of the piston, the cover plate prevents a cooling of the piston because no flow can form.

SUMMARY OF THE INVENTION

It is an object of the invention to provide an internal combustion engine of the type described above wherein an effective cooling is obtained at each position of the piston.

The internal combustion engine of the invention includes: a cylinder having a cylinder wall; a piston movably mounted in the cylinder; the cylinder and the piston conjointly delimiting a combustion chamber; a crankcase connected to the cylinder; the crankcase defining a crankcase interior space and having a mixture inlet into the crankcase interior space; a crankshaft having an outer periphery and being rotatably mounted in the interior space of the crankcase; a connecting rod connecting the piston to the crankshaft to permit the piston to drive the crankshaft in a rotational direction; at least one flow conducting element fixedly mounted in the interior space of the crankcase at a predetermined location therein; and, the flow conducting element projecting into the interior space and being directed opposite to the rotational direction of the crankshaft.

The flow conducting element can direct mixture to the piston base in each position of the piston because of the spatially fixed arrangement of this flow conducting element. In this way, an air flow is generated during the entire piston stroke which functions to cool the piston.

The flow conducting element advantageously has a flow edge directed opposite to the rotational direction of the crankshaft. The flow edge deflects a portion of the flow, which is formed in the interior space of the crankcase, to the piston base and to the piston pin. The flow edge functions especially as a flow divider. The piston is advantageously connected to the connecting rod via a piston pin. The flow conducting element has a flow conducting surface which lies facing toward the piston pin in order to achieve an effective cooling of the piston pin and of the piston pin bearing. The separated flow can flow along the flow conducting surface and is so directed toward the piston pin.

The internal combustion engine advantageously has an imaginary plane which is perpendicular to the cylinder longitudinal axis and tangential to the outer periphery of the crankshaft. The distance of the flow edge to the plane amounts to less than approximately 40% of the piston stroke. Advantageously, the distance is less than approximately 30% of the piston stroke and especially less than approximately 20% of the piston stroke. A distance of less than approximately 30% or less than approximately 20% of the piston stroke is provided for flow conducting elements which are mounted on the wall of the interior space of the crankcase lying opposite to the mixture inlet. The outer periphery of the crankshaft is the region lying furthest away from the rotational axis of the crankshaft. This is usually the radially outer-lying region of the crankwebs of the crankshaft.

Advantageously, the flow conducting element is mounted next to the outer periphery of the crankshaft. Intense flows result in the region of the crankshaft because of the rotation of the crankshaft during operation. A sufficient quantity of mixture is directed to the piston base and the piston pin because of the arrangement of the flow conducting element next to the outer periphery of the crankshaft. The mixture, which is branched off in the region of the outer periphery of the crankshaft, has a sufficiently high flow velocity so that an effective cooling of the piston pin and the piston base results.

Advantageously, the flow conducting element is mounted on the cylinder. However, the flow conducting element can also be arranged on the crankcase. A simple configuration without additional components is achieved when a cylinder base seal is arranged between the cylinder and the crankcase and the flow conducting element is formed by a section of the cylinder base seal. However, the flow conducting element can also be clampingly held. Advantageously, the flow conducting element is clampingly held between the crankcase and the cylinder. This is especially advantageous when the partition plane between cylinder and crankcase runs in the region of the lower edge of the cylinder running surface. A flow conducting element can, however, also be clampingly held in a partition plane which runs at the elevation of the crankshaft. It can also be advantageous that the flow conducting element is clampingly held between two components of the crankcase, especially, between two crankcase half shells. Also, a clamping at a component of the cylinder or crankcase is possible. In this way, no additional components are needed to fix the flow conducting element. The position of the flow conducting element can thereby be constructively pregiven in a simple manner. It can also be provided that the flow conducting element is configured as one part with the cylinder or with the crankcase. The flow conducting element is especially formed on the cylinder or on the crankcase.

The flow conducting element is advantageously mounted on the wall of the interior space of the crankcase lying opposite to the mixture inlet. In this way, the flow is partitioned into component flows. However, it can also be provided that the flow conducting element is mounted at the side of the interior space of the crankcase facing toward the mixture inlet and that a passthrough is formed between the wall of the crankcase interior space and the flow conducting element. In this way, the mixture flows in the region of the crankshaft and the mixture, which is directed to the piston, flows along an opposite-lying side of the flow conducting element. The size of the passthrough between the flow conducting element and the wall of the crankcase interior space determines the mixture quantity directed to the piston.

Additionally, a jet or nozzle effect can be obtained with a suitable configuration of the flow conducting element.

The internal combustion engine has at least one transfer channel whose end at the crankcase end is open to the interior space of the crankcase in each position of the piston and the end of the transfer channel at the combustion chamber is controlled by the piston slot. The cooling of the piston base and of the piston pin is thereby substantially independent of the control times of the transfer channels.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
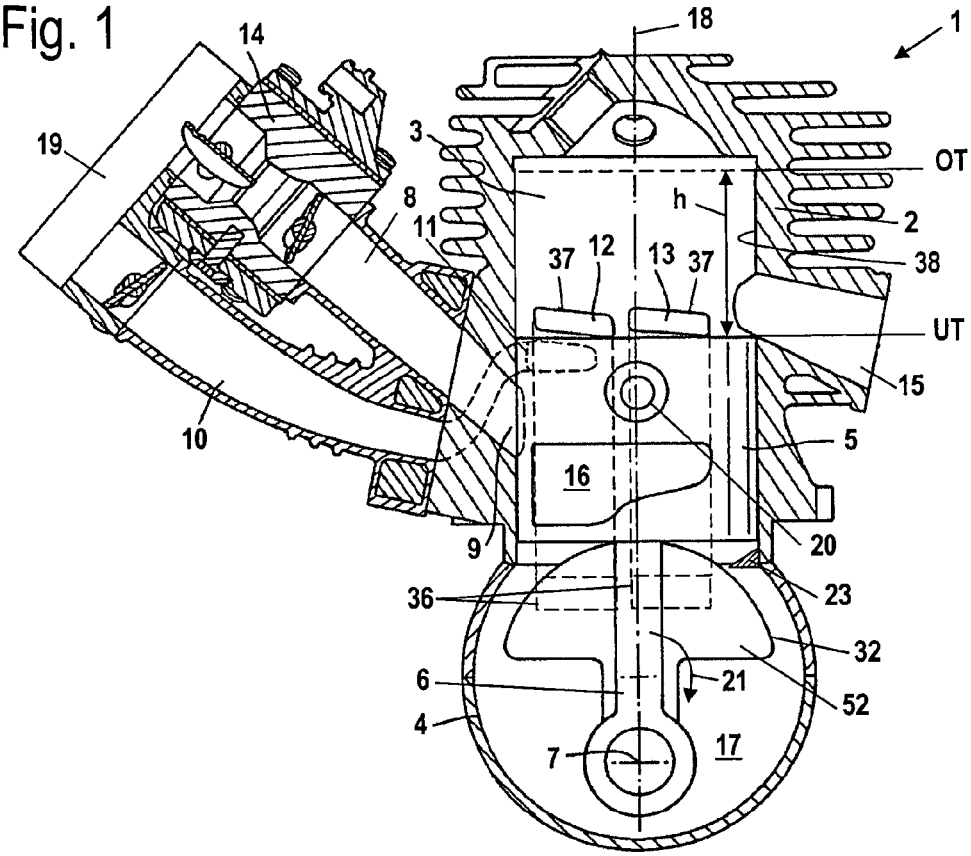
FIG. 1 is a schematic section view of a two-stroke engine.

FIG. 1 shows as an example for an internal combustion engine a two-stroke engine 1 which operates with scavenging advance air. The invention can, however, also be advantageous for a mixture-lubricated four-stroke engine. The two-stroke engine 1 has a cylinder 2 in which a combustion chamber 3 is formed. The combustion chamber 3 is delimited by a piston 5 which is journalled in the cylinder 2 for back and forth movement in the direction of a cylinder longitudinal axis 18. The piston 5 drives a crankshaft 7 via a connecting rod 6. The crankshaft 7 is journalled in a crankcase 4 and is driven by the piston 5 in a rotational direction 21.

The two-stroke engine 1 has a mixture channel which opens with a mixture inlet 9 at the cylinder bore 38. The mixture inlet 9 is mounted in a region over which the piston 5 is moved during operation so that the mixture inlet 9 is slot controlled. For supplying fuel, a carburetor 14 is provided wherein a section of the mixture channel 8 is formed. The carburetor 14 is mounted on an air filter 19 via which combustion air is inducted. An air channel 10 also opens at the air filter 19. The air channel 10 opens at the cylinder bore 38 with an air inlet 11 which is likewise slot controlled by the piston 5.

The two-stroke engine 1 has two transfer channels on each side of the cutting plane shown in FIG. 1, namely, an inlet-near transfer channel 12 as well as an outlet-near transfer channel 13 which is arranged next to an outlet 15 from the combustion chamber 3. The transfer channels (12, 13) open with transfer windows 37 into the combustion chamber 3. The transfer channels 12 and 13 connect the crankcase interior space 17 with the combustion chamber 3 in the region of bottom dead center UT shown in FIG. 1. The transfer channels 12 and 13 have openings 36 at their crankcase ends which open into the crankcase 4. The openings 36 are arranged in a region which is not passed over by the piston 5 during operation. In this way, the openings 36 are open to the crankcase interior space 17 during the entire piston stroke.

In the region of bottom dead center UT shown in FIG. 1, an air/fuel mixture flows during operation from the crankcase interior space 17 via the transfer channels (12, 13) into the combustion chamber 3. The mixture in the combustion chamber 3 is compressed in the following upward stroke of the piston 5. The mixture is ignited in the combustion chamber 3 by a spark plug (not shown) in the region of top dead center OT of the piston 5. In this way, the piston is accelerated toward the crankcase 4. With the downward stroke, the piston 5 opens the outlet 15 so that exhaust gases can escape from the combustion chamber 3. With a further downward movement, the piston 5 opens the transfer windows 37 through which fresh mixture afterflows from the crankcase 4 into the combustion chamber 3.

The mixture inlet 9 is open to the crankcase interior space 17 at top dead center OT. An air/fuel mixture from the mixture channel 8 flows into the crankcase interior space 17 at top dead center OT. At top dead center OT, the air inlet 11 is connected via respective piston pockets 16 to the transfer windows 37 of each two transfer channels (12, 13) so that substantially fuel-free air from the air channel 10 can be advance stored in the transfer channels (12, 13). As soon as the transfer windows 37 are opened by the piston 5 during the downward stroke thereof, substantially fuel-free air first flows from the air channel 10 into the combustion chamber 3 and separates the fresh mixture after flowing from the crankcase interior space 17 from the exhaust gases flowing out from the combustion chamber 3 through the outlet 15. Thereafter, fresh mixture flows from the crankcase interior space 17 via the transfer channels (12, 13) into the combustion chamber 3. The piston 5 moves through the piston stroke (h) between the top dead center OT and bottom dead center UT. The piston stroke (h) is measured in the direction of the longitudinal axis 18 of the cylinder.

Figure 2:
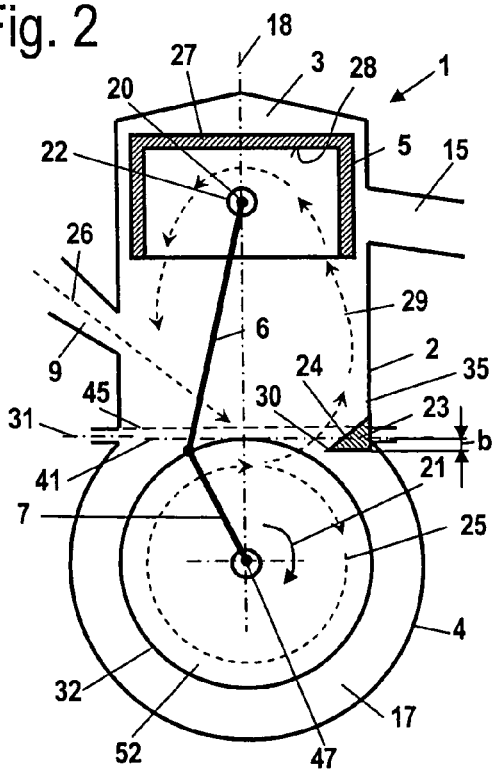
FIG. 2 is a simplified schematic of the two-stroke engine of FIG. 1.

The connecting rod 6 is connected to the piston 5 via a piston pin 20. As shown schematically in FIG. 2, the piston pin 20 is journalled in the piston 5 in a piston pin bearing 22 which, for example, can be a roller bearing and can especially be a needle bearing. As shown in FIG. 2, an air/fuel mixture from the mixture channel 8 flows in a flow direction 26 into the crankcase interior space 17. Because of the rotational movement of the crankshaft 7, a circular flow in a flow direction 25 is formed in the crankcase interior space 17 in the region of the crankshaft 7. In the crankcase interior space 17, a flow conducting element 23 is mounted at the elevation of a partition plane 31 between the crankcase 4 and the cylinder 2. The flow conducting element 23 is mounted on a wall 35 of the crankcase interior space 17 which lies opposite to the inlet 9. The flow conducting element 23 has a flow edge 30 which is directed opposite to the flow direction 25. The flow edge 30 is arranged close to the outer periphery 32 of the crankshaft 7 which is also shown in FIG. 1. The radially outermost region of the crankshaft 7 is characterized as the outer periphery 32 referred to the rotational axis 47 of the crankshaft 7. As shown in FIG. 1, the radial outermost region of the crankshaft 7 is at the crankwebs 52. The partition plane 31 is arranged in the region of the lower edge 45 of the cylinder running surface with this lower edge facing toward the crankcase 4. The partition plane 31 is therefore disposed-offset relative to the rotational axis 47 of the crankshaft 7 in the direction toward the cylinder 2.

The flow conducting element 23 has a flow conducting surface 24 which lies facing toward the piston pin 20. Advantageously, a perpendicular to the flow conducting surface 24 cuts the piston pin 20.

As shown in FIG. 2, the flow conducting element 23 branches off a component flow from the flow present in the region of the crankshaft 7 and flowing in flow direction 25. The flow conducting element directs this component flow to the piston 5. The branched-off component flow flows as a cooling air flow 29 on the side of the cylinder 2 facing toward the outlet 15 to the lower side 28 of the piston base 27 facing toward the crankcase interior space 17. The cooling air flow flows between the piston pin 20 and the lower side 28 and flows back to the crankshaft 7 on the side of the cylinder 2 facing toward the inlet 9. A circular-shaped flow results in the part of the crankcase interior space 17 delimited by the cylinder 2.

The flow conducting element 23 is mounted approximately at the elevation of the partition plane 31 between cylinder 2 and crankcase 4. The internal combustion engine 1 has an imaginary plane 41 which perpendicularly cuts the cylinder longitudinal axis 18 and is disposed at the side of the crankshaft 7 facing toward the piston 5. The imaginary plane 41 lies tangentially to the outer periphery 32 of the crankwebs 52 of the crankshaft 7. The outer periphery 32 thereby touches the imaginary plane 41. The flow edge 30 is at a distance (b) to the imaginary plane 41 which is less than approximately 40% of the piston stroke (h). The distance (b) advantageously is less than approximately 30% and especially less than approximately 20% of the piston stroke (h). In the embodiment of FIG. 2, the flow edge 30 is arranged at the side of the imaginary plane 41 facing toward the crankshaft 7.

Figure 3:
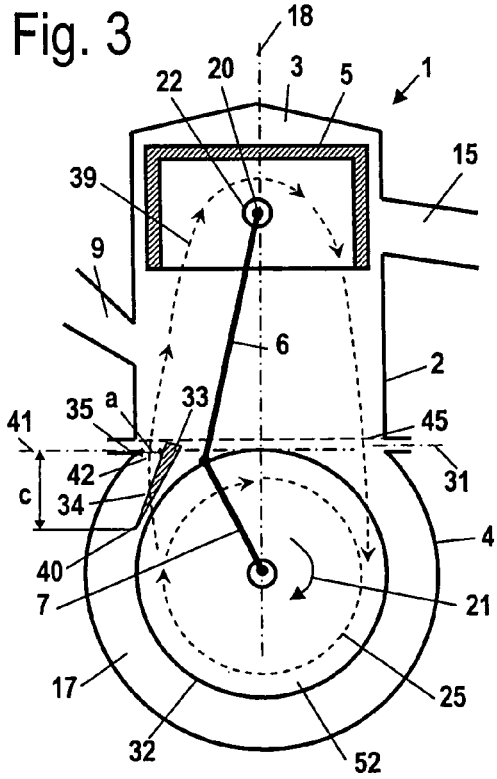
FIGS. 3 to 8 are schematics of embodiments of a two-stroke engine.

In FIG. 3, an embodiment for the two-stroke engine 1 is shown. The configuration of the two-stroke engine 1 corresponds to the two-stroke engine shown in FIGS. 1 and 2. The same reference numerals identify corresponding components in all figures. In the two-stroke engine 1 shown in FIG. 3, a flow conducting element 33 is provided which is mounted on the side of the crankcase interior space 17 facing toward the mixture inlet 9. The flow conducting element 33 is arranged at a distance (a) from the wall 35 delimiting the crankcase interior space. The distance (a) is measured perpendicularly to the longitudinal axis 18 of the cylinder. In this way, a passthrough 42 is formed between the wall 35 and the flow conducting element 33. The flow conducting element 33 has a flow edge 40 which projects into the region of the outer periphery 32 of the crankshaft 7. The distance of the flow edge 40 to the outer periphery 32 of the crankshaft 7 is so selected that a contact of the flow edge 40 with the outer periphery 32 of the crankshaft 7 is reliably avoided.

The flow conducting element 33 has a flow conducting surface 34 which faces toward the wall 35. During operation, the flow edge 40 of the flow conducting element 33 leads to the situation that a cooling air flow 39 is branched off from the air flow flowing in the crankcase 4 in the flow direction 25. This cooling air flow 39 flows through the passthrough 42 between the flow conducting element 33 and the wall 35 and flows along the flow conducting surface 34. The cooling air flow 39 flows on the side of the cylinder 2, which faces toward the inlet 9, to the lower side 28 of the piston 5. The cooling air flow 39 flows between piston pin 20 and the lower side 28 of the piston 5 and again flows back into the region of the crankshaft 7 on the side of the cylinder 2 facing toward the outlet 15. The flow edge 40 is arranged below the partition plane 31 and below the imaginary plane 41. The flow edge 40 is at a distance (c) to the imaginary plane 41 and this distance (c) is advantageously less than approximately 40% of the piston stroke (h).

Figure 4:
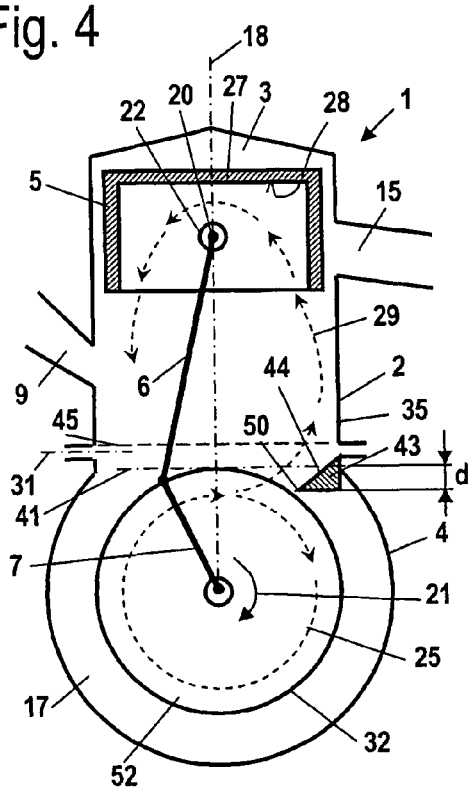

FIG. 4 shows an embodiment of the internal combustion engine wherein a flow conducting element 43 is mounted on the crankcase 4. The flow conducting element 43 can be configured as one piece with the crankcase 4 or can be fixed on the crankcase 4. The flow conducting element 43 can, for this purpose, be clipped, for example, on the crankcase 4. The flow conducting element 43 can also be clampingly held at the crankcase 4. The flow conducting element 43 is mounted on the wall 35 lying opposite to the inlet 9 and has a flow edge 50 which projects close to the outer periphery 32 of the crankshaft 7. The flow edge 40 and a flow conducting surface 44 of the flow conducting element 43 branch off a cooling air flow 29 which is deflected by the flow conducting element 43 to the piston 5. The resulting air flow corresponds approximately to the cooling air flow 29 in the embodiment of FIG. 2. The flow edge 50 is at a distance (d) to the imaginary plane 41 which is less than approximately 40%. of the piston stroke (h). The distance (d) is advantageously less than approximately 30% and especially less than approximately 20% of the piston stroke (h). The flow conducting element 43 can also be configured as an insert piece in the crankcase 4.

Figure 5:
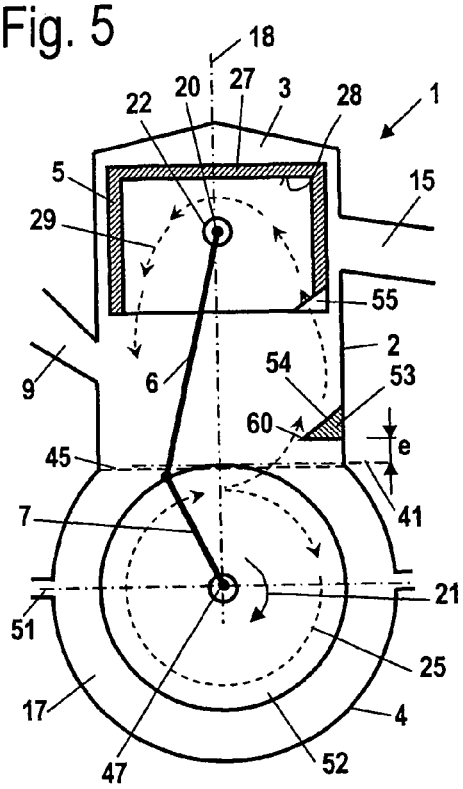

In the embodiment of FIG. 5, a flow conducting element 53 is provided on the cylinder 2. The flow conducting element 53 can be configured to be one piece with the cylinder 2, that is, formed on the cylinder 2 or the flow conducting element 53 can be manufactured as a separate part and can be fixed on the cylinder 2, for example, clipped onto the cylinder 2 or clampingly held thereon. The cylinder 2 is connected to the crankcase 4 at a partition plane 51 which runs at the elevation of the rotational axis 47 of the crankshaft 7. In this way, an upper section of the crankcase is formed on the cylinder 2. The flow conducting element 53 has a flow conducting surface 54 facing toward the piston pin 20 and the piston pin bearing 22. The flow conducting element 53 has a flow edge 60 which lies in the opposite direction to the flow direction 25, which results in the region of the crankshaft 7, and therefore also lies opposite to the rotational direction 21 of the crankshaft 7. The flow conducting element 53 conducts a portion of the air/fuel mixture, which flows in the region of the crankshaft 7, as a cooling air flow 29 to the piston 5. The flow edge 60 is at a distance (e) to the imaginary plane 41 which is less than approximately 40% of the piston stroke (h). In the embodiment of FIG. 5, the flow edge 60 is disposed above the lower edge 45 of the cylinder running surface, that is, in the region of the cylinder running surface. In this region, the piston 5 advantageously has a corresponding cutout 55 in order to avoid a contact with the flow conducting element 53.

Figure 6:
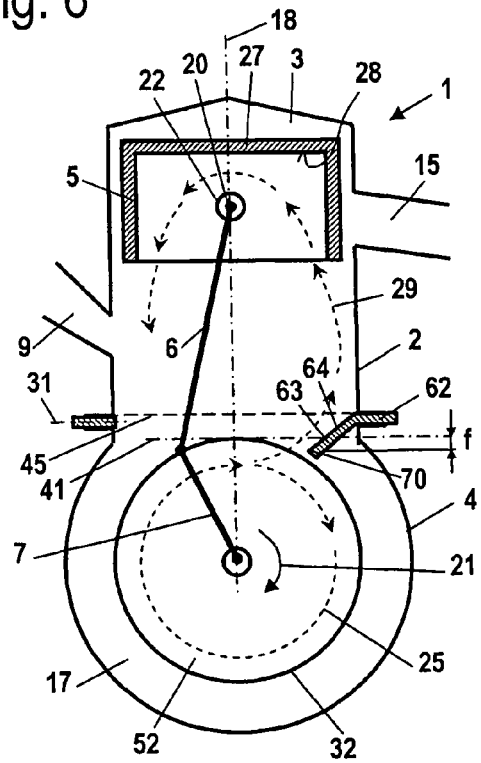

In the embodiment shown in FIG. 6, a flow conducting element 63 is configured as one piece with a cylinder base seal 62 arranged between the cylinder 2 and the crankcase 4. The flow conducting element 63 can also be elastically configured. The flow conducting element 63 has a flow edge 70, which lies opposite to the rotational direction 21 of the crankshaft 7, as well as a flow conducting surface 64 which is aligned facing toward the piston pin 20. The resulting flow in the crankcase interior space 17 corresponds to the cooling air flow 29 described with respect to FIG. 2. The flow edge 70 is at a distance (f) to the imaginary plane 41 and this distance (f) is less than approximately 40% of the piston stroke (h). Advantageously, the distance (f) is less than approximately 30% of the piston stroke (h) and is especially less than approximately 20% of the piston stroke (h). The flow edge 70 is arranged next to the outer periphery 32 of the crankshaft 7.

Figure 7:
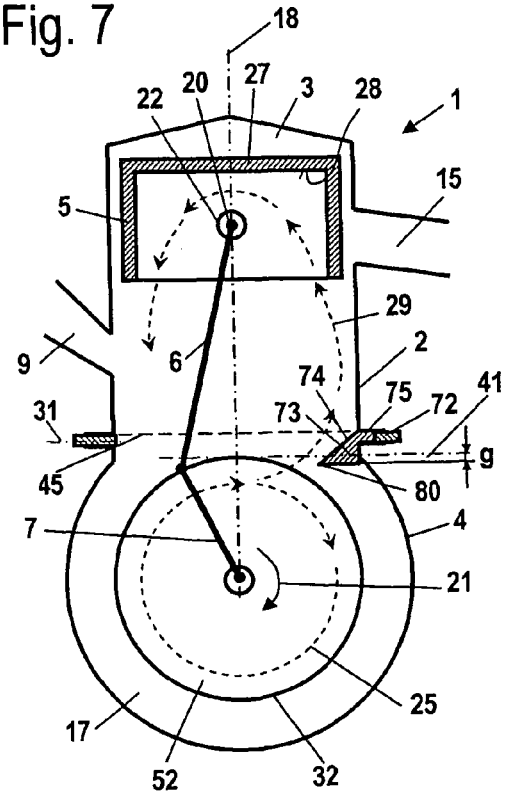

In the embodiment shown in FIG. 7, a flow conducting element 73 is configured as a separate component. The flow conducting element 73 has an edge 75 which projects into the region between the cylinder 2 and the crankcase 4. A cylinder base seal 72 is arranged between the cylinder 2 and the crankcase 4. The edge 75 of the flow conducting element 73 is clampingly held between the cylinder 2 and the crankcase 4. Screws (not shown) serve to develop the clamping force with which the cylinder 2 is mounted on the crankcase 4. The flow conducting element 73 has a flow conducting surface 74, which lies facing toward the piston pin 20, as well as a flow edge 80 which is arranged below the partition plane 31 next to the outer periphery 32 of the crankshaft 7. The flow edge 80 is at a distance (g) to the imaginary plane 41 and this distance (g) is less than approximately 40% of the piston stroke (h). Advantageously, the distance (g) is less than approximately 30% of the piston stroke (h) and is especially less than approximately 20% of the piston stroke (h). The flow conducting element 73 is arranged at the wall of the crankcase 4 lying opposite to the mixture inlet 9 so that the cooling air flow 29 results which is described also with respect to FIG. 2.

A distance of the flow edge of up to 40% of the piston stroke (h) is provided especially for flow conducting elements which are arranged on the side of the internal combustion engine 1 facing toward the mixture inlet 9. A distance of the flow edge to the imaginary plane 41 of up to approximately 30% and especially of up to approximately 20% of the piston stroke (h) is advantageous especially for flow conducting elements which are arranged on the side of the internal combustion engine 1 lying opposite the mixture channel 9 and facing toward the outlet 15.

During the entire piston stroke, a cooling air flow (29, 39) results because the flow conducting element is arranged spatially fixed at the crankcase interior space 17. The cooling flow (29, 39) cools the piston pin 20 and the piston pin bearing 22.

Additionally or alternatively to the partition plane 31, a crankcase partition plane 51 can be provided at the elevation of the rotational axis 47 of the crankshaft 7. The partition plane 51 is shown in FIG. 5. The flow conducting element is advantageously arranged approximately at the elevation of the edge of the crankshaft 7 facing toward the cylinder 2 in the region of the imaginary plane 41 independently of the arrangement of the partition plane.

Figure 8:
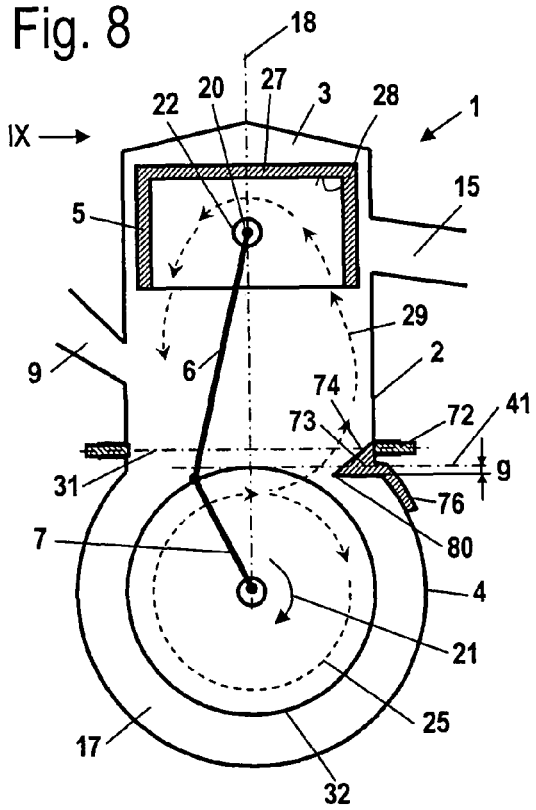
Figure 9:
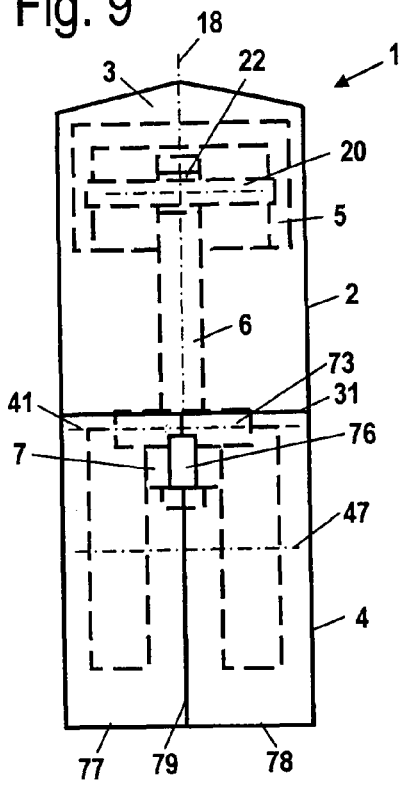
FIG. 9 is a schematic side elevation view of the two-stroke engine of FIG. 8 viewed in the direction of arrow IX in FIG. 8.

FIGS. 8 and 9 show an embodiment of the internal combustion engine 1 whose flow conducting element 73 corresponds essentially to the flow conducting element of FIG. 7. The internal combustion engine 1 of FIGS. 8 and 9 has a first partition plane 31 between the cylinder 2 and the crankcase 4. The crankcase 4 is partitioned vertically at a partition plane 79 and is built up of a first crankcase half shell 77 and a second crankcase half shell 78 which mutually abut at the partition plane 79. As shown in FIG. 8, the flow conducting element 73 has an edge 76 which is arranged at the elevation of the crankcase 4 and projects between the two crankcase half shells 77 and 78. This is shown schematically in FIG. 9. The flow conducting element 73 of FIGS. 8 and 9 is clampingly held with its edge 76 between the two crankcase half shells 77 and 78. A flow conducting element can also be clamped between other neighboring components or on a component.

Figure 10:
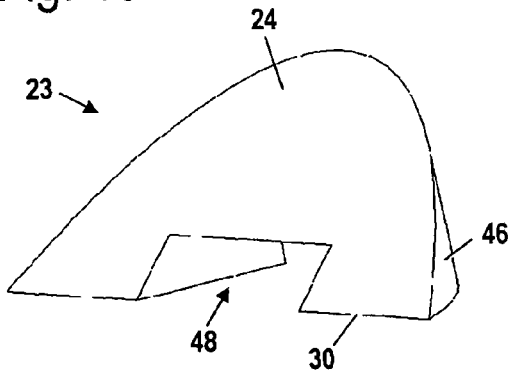
FIG. 10 is a perspective view of a flow conducting element.
Figure 11:
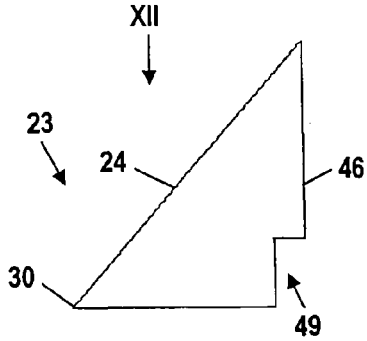
FIG. 11 is a side elevation view of the flow conducting element of FIG. 10; and, FIG. 12 is a side elevation view of the flow conducting element viewed in the direction of arrow XII in FIG. 11.
Figure 12:
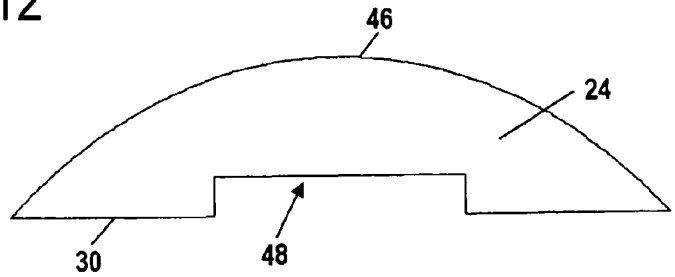

In FIGS. 10 to 12, the flow conducting element 23 of FIG. 2 is shown. As the figures show, the flow conducting element 23 has a round back wall 46 which is configured for contact engagement at the inner wall of the cylinder 2. In the flow conducting surface 24, a cutout 48 is provided at the side facing toward the crankshaft 7 and the contour of this cutout 48 is determined by the envelope conjointly defined by connecting rod 6 and crankshaft 7 during a rotation of the crankshaft 7. The width of the cutout 48 corresponds to the width of the connecting rod 6. Because of the cutout 48, the connecting rod 6 can dip slightly into the flow conducting element 23 during the stroke movement of the piston 5. As FIG. 11 shows, the flow conducting element 23 has a cutout 49 on the side facing toward the cylinder wall. This cutout 49 serves for fixing the flow conducting element 23. Also, other configurations of the flow conducting element 23 can be provided.

In order to clamp the flow conducting element at the partition plane 51 shown in FIG. 5, the flow conducting element can have a strut projecting downwardly to the elevation of the rotational axis 47 of the crankshaft 7. The strut is clampingly held at the partition plane 51.

It is understood that the foregoing description is that of the preferred embodiments of the invention and that various changes and modifications may be made thereto without departing from the spirit and scope of the invention as defined in the appended claims.

What is claimed is:

1. A mixture-lubricated internal combustion engine comprising:

a cylinder having a cylinder wall;

a piston movably mounted in said cylinder;

said cylinder and said piston conjointly delimiting a combustion chamber;

a crankcase connected to said cylinder;

said crankcase defining a crankcase interior space and having a mixture inlet into said crankcase interior space through which an air/fuel mixture flows into said crankcase;

a crankshaft having an outer periphery and being rotatably mounted in said interior space of said crankcase;

a connecting rod connecting said piston to said crankshaft to permit said piston to drive said crankshaft in a rotational direction causing said air/fuel mixture to flow in the region of said crankshaft;

at least one flow conducting element fixedly mounted in said interior space of said crankcase at a predetermined location therein; and, said flow conducting element projecting into said interior space and being directed opposite to said rotational direction of said crankshaft so as to branch off a component flow of said air/fuel mixture flowing in the region of said crankshaft and diverting said component flow to said piston thereby cooling said piston during operation of said engine.

2. The internal combustion engine according to claim 1, wherein said flow conducting element has a flow edge directed opposite to said rotational direction of said crankshaft.

3. The internal combustion engine according to claim 2, further comprising a piston pin connecting said piston to said connecting rod; and, said flow conducting element having a flow conducting surface facing toward said piston pin.

4. The internal combustion engine according to claim 3, wherein said cylinder has a longitudinal axis and said piston is movably mounted in said cylinder so as to move through a piston stroke (h) during operation of said engine; and, said internal combustion engine further comprises an imaginary plane perpendicular to said cylinder axis and tangential to said outer periphery of said crankshaft; and, said flow edge of said flow conducting element being spaced from said imaginary plane at a distance corresponding to less than 40% of said piston stroke (h).

5. The internal combustion engine according to claim 4, wherein said flow edge is spaced at a distance from said imaginary plane corresponding to less than 30% of said piston stroke (h).

6. The internal combustion engine according to claim 1, wherein said flow conducting element is disposed adjacent said outer periphery of said crankshaft.

7. The internal combustion engine according to claim 1, wherein said flow conducting element is disposed on said cylinder.

8. The internal combustion engine according to claim 1, wherein said flow conducting element is disposed on said crankcase.

9. The internal combustion engine according to claim 1, further comprising a cylinder base seal disposed between said cylinder and said crankcase; and, said flow conducting element being formed by a portion of said cylinder base seal.

10. The internal combustion engine according to claim 1, wherein said flow conducting element is mounted by being clamped.

11. The internal combustion engine according to claim 10, wherein said flow conducting element is clamped between said crankcase and said cylinder.

12. The internal combustion engine according to claim 10, wherein said crankcase comprises two assembly components and said flow conducting element is clamped between said assembly components.

13. The internal combustion engine according to claim 1, wherein said crankcase has a wall defining said crankcase interior space; and, said flow conducting element is disposed on said wall opposite of said mixture inlet.

14. The internal combustion engine according to claim 1, wherein said crankcase has a wall defining said crankcase interior space; said flow conducting element is disposed in said interior space of said crankcase facing toward said mixture inlet; and, said wall and said flow conducting element conjointly define a passthrough therebetween.

15. The internal combustion engine according to claim 1, further comprising at least one transfer channel having a first end communicating with said crankcase and a second end communicating with said combustion chamber; and, said first end being open to said crankcase interior space for each position of said piston and said second end being slot controlled by said piston.

16. The internal combustion engine of claim 4, wherein said crankshaft has a side facing toward said piston; and, said imaginary plane is disposed on said side of said crankshaft.

17. The internal combustion engine of claim 1, further comprising at least one transfer channel through which said air/fuel mixture flows from said interior space of said crankcase into said combustion chamber.

18. A mixture-lubricated internal combustion engine comprising:

a cylinder defining a longitudinal cylinder axis;

a piston movably mounted in said cylinder so as to move through a piston stroke (h) during operation of said engine;

said cylinder and said piston conjointly delimiting a combustion chamber;

a crankcase connected to said cylinder;

said crankcase defining a crankcase interior space and having a mixture inlet into said crankcase interior space through which an air/fuel mixture flows into said crankcase;

a crankshaft having an outer periphery and being rotatably mounted in said interior space of said crankcase;

a connecting rod connecting said piston to said crankshaft to permit said piston to drive said crankshaft in a rotational direction causing said air/fuel mixture to flow in the region of said crankshaft;

an imaginary plane perpendicular to said cylinder axis and tangential to said outer periphery of said crankshaft and said imaginary plane being arranged on the side of said crankshaft facing toward said piston;

at least one flow conducting element fixedly mounted in said interior space of said crankcase at a predetermined location therein;

said flow conducting element projecting into said interior space and being directed opposite to said rotational direction of said crankshaft;

said flow conducting element having a flow edge directed opposite to said rotational direction of said crankshaft;

said flow edge of said flow conducting element being spaced from said imaginary plane at a distance corresponding to less than 40% of said piston stroke (h); and, said flow edge being configured to branch off a component flow of said air/fuel mixture flowing in the region of said crankshaft and to divert said component flow to said piston thereby cooling said piston during operation of said engine.

* * * * *